US005146660A

United States Patent [19]

Ritter

[11] Patent Number: 5,146,660

[45] Date of Patent: Sep. 15, 1992

[54] DEVICE FOR AIR-INTERMINGLING MULTIFILAMENT YARNS

[75] Inventor: Helmut Ritter, Wattwil, Switzerland

[73] Assignee: Heberlein Maschinenfabrik AG, Wattwil, Switzerland

[21] Appl. No.: 719,114

[22] Filed: Jun. 20, 1991

[30] Foreign Application Priority Data

Jul. 2, 1990 [CH] Switzerland ..... 2197/90

[51] Int. Cl.[5] ..... D02G 1/16

[52] U.S. Cl. ..... 28/274; 28/272; 28/271

[58] Field of Search ..... 28/274, 272, 271, 273

[56] References Cited

U.S. PATENT DOCUMENTS

| | | | |
|---|---|---|---|
| 3,535,755 | 9/1970 | Brown | 28/274 |
| 3,574,249 | 4/1971 | Cannon | 28/274 |
| 3,614,817 | 9/1971 | Nicita et al. | 28/274 |
| 3,638,291 | 2/1972 | Yngve | 28/273 |
| 3,659,350 | 5/1972 | Mc Cullough | 28/274 X |
| 3,703,751 | 11/1972 | Bowen | 28/273 |
| 4,345,425 | 8/1982 | Negishi et al. | 28/274 X |
| 4,346,552 | 8/1982 | Negishi et al. | 57/208 |
| 4,392,285 | 7/1983 | Stables et al. | 28/274 X |
| 4,949,441 | 8/1990 | Ethridge | 28/274 X |
| 4,993,130 | 2/1991 | Coons, III et al. | 28/274 X |
| 5,010,631 | 4/1991 | Ritter | 28/274 |

FOREIGN PATENT DOCUMENTS

| | | | |
|---|---|---|---|
| 0140526 | 5/1985 | European Pat. Off. | 28/274 |
| 0043142 | 4/1984 | Japan | 28/274 |
| 2178072 | 2/1987 | United Kingdom . | |

*Primary Examiner*—Werner H. Schroeder
*Assistant Examiner*—Bibhu Mohanty
*Attorney, Agent, or Firm*—Young & Thompson

[57] ABSTRACT

The device comprises a body (1, 2) with a continuous yarn channel into which terminate a blast nozzle (7) and a threading slot (8). The yarn channel is defined by two hollow wall surfaces (11.1, 11.2 and 12.1, 12.3) emanating from respectively one rim of the orifice of the threading slot (8) and being symmetrical with respect to a plane of symmetry (E) containing the axis (A) of the yarn channel. The two wall surfaces contain jointly at least four component surfaces (11.1, 11.2, 11.3, 12.1, 12.2, 12.3) of which at least two (11.1, 11.2, 12.1, 12.2, 12.3) are planar. The rim of the orifice of the threading slot (8) lying on the side of the blast nozzle (7) has a larger spacing from the plane of symmetry (E) than the other rim. Thread guides (13) are inserted in the body (1, 2) at both ends of the yarn channel, keeping the multifilament yarn to be air-bulked at a distance from the orifice of the blast nozzle (7). This geometry achieves, with a low consumption of blowing air, high air-bulking densities, measured as the number of air-bulk knots per meter of yarn length.

6 Claims, 2 Drawing Sheets

DEVICE FOR AIR-INTERMINGLING MULTIFILAMENT YARNS

FIELD OF THE INVENTION

The invention relates to a device for air-intermingling multifilament yarns, with a unit containing a continuous yarn channel into which terminate, in each case laterally, at least one blast nozzle as well as a threading slot.

BACKGROUND OF THE INVENTION

Such air-bulking devices with a threading slot that is constantly open to provide for simple handling have been known in various designs.

In recent years, the requirements to be met by air-bulking devices for smooth yarns, preoriented yarns (POY yarns), fully oriented yarns (FOY yarns) and fully drawn yarns (FDY yarns) have greatly increased due to a growing usage of filament yarns with ever finer individual filaments. The finer monofilaments require, for troublefree further processing, an improved compactness of the thread with a minimum of projecting filament loops, meaning for the air-bulking of these filament yarns a requirement for increasingly shorter opening lengths between the air-bulk knots. This means, at the same time, that the air-bulking density, measured as the number of air-bulk knots or fixed points per meter of yarn length (FP/m), must be raised to ever higher values.

It is an object of the invention to fashion the above-discussed device in such a way that the required high air-bulking density can be attained at a high uniformity of the fixed point spacings—without the occurrence of individual larger fixed point spacings or opening lengths—and with a very low blowing air consumption per air-bulk knot.

This object has been achieved according to the invention by the combination of features indicated in the characterizing portion of claim 1.

Individual features have been known per se in air-bulking devices. Thus, a person skilled in the art knows that air-bulking devices having predominantly round (cylindrical) yarn channels are suitable for low to medium air-bulking densities but that, for higher air-bulking densities, air-bulking devices are utilized with yarn channels exhibiting usually a planar impingement surface for the blast jet from the blast nozzle and even including, in part, up to three planar surfaces.

SUMMARY OF THE INVENTION

The invention is based on the realization that it is not only necessary for the wall surfaces of the yarn channel to include at least two planar component surfaces, but that it is also required to guide the yarn very accurately within the air-bulking device, for which purpose thread guides must be inserted in the body of the device at both ends of the yarn channel. Moreover, the yarn should come into contact during operation only with the second hollow wall surface lying in opposition to the orifice of the blast nozzle but hardly at all with the first hollow wall surface containing the orifice of the blast nozzle. For this reason, the rim of the orifice of the threading slot from which the first wall surface emanates has a larger distance from the plane of symmetry than the other rim of the orifice of the threading slot. The portion of the yarn channel defined by the first wall surface serves, besides accommodating the blast nozzle, primarily for guiding the blowing medium in a manner beneficial for the swirl effect toward the two ends of the yarn channel.

In order to avoid constriction of the flow cross section for the blowing medium by the thread guides lateral outlet openings can be provided which emanate from the yarn channel in front of the thread guides as seen from the orifice of the blast nozzle.

The body of the device according to this invention can be of a one-piece or multipartite structure. In a preferred embodiment, the body can be composed of a nozzle unit section containing the blast nozzle, with the first hollow wall surface, and of a baffle unit section, attached to the nozzle unit section in an exchangeable fashion, with the second hollow wall surface. In such an embodiment, different air-bulking density ranges can be obtained by a simple exchange of the baffle unit section under the same operating conditions. Thus, the air-bulking density can be lowered to below one-half when exchanging a baffle unit section wherein the second hollow wall surface is a prismatic surface having an approximately rectangular cross section against another baffle unit section wherein the second hollow wall surface is a cylindrical surface with an approximately semicircular cross section, without weakening the air-bulk knots as would be the case when lowering the pressure at the blast nozzle. Also, the regularity of the fixed point spacings is still very much greater in case of the baffle unit section with a cylindrical wall surface—as a consequence of the thread guides inserted in the body of the device—than in case of pressure lowering for reducing the air-bulking density. The possibility of effecting precision regulation of the air-bulking density by varying the blast pressure can then still be utilized in addition. The exchangeable baffle unit sections can furthermore consist of differing materials and/or can exhibit differently worked surfaces.

BRIEF DESCRIPTION OF THE DRAWINGS

Embodiments of the device according this invention will be described in greater detail below with reference to the drawings wherein.

DETAILED DESCRIPTION OF THE INVENTION

Figure 1:
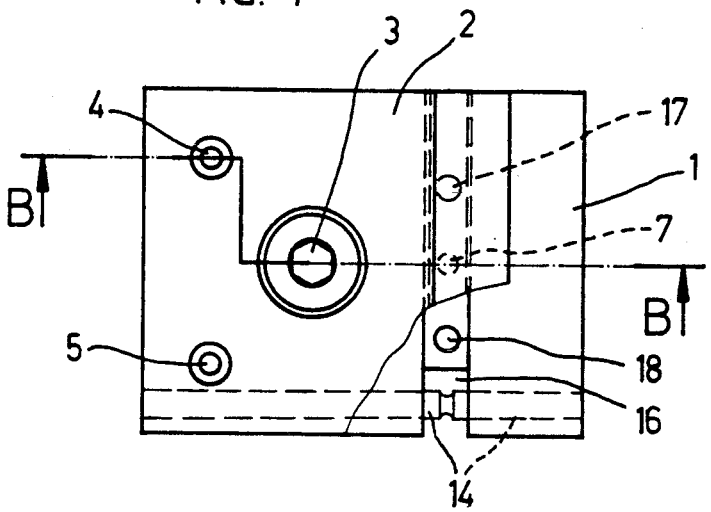
FIG. 1 shows a top view of the body of an air-bulking device, a portion thereof being broken away.
Figure 2:
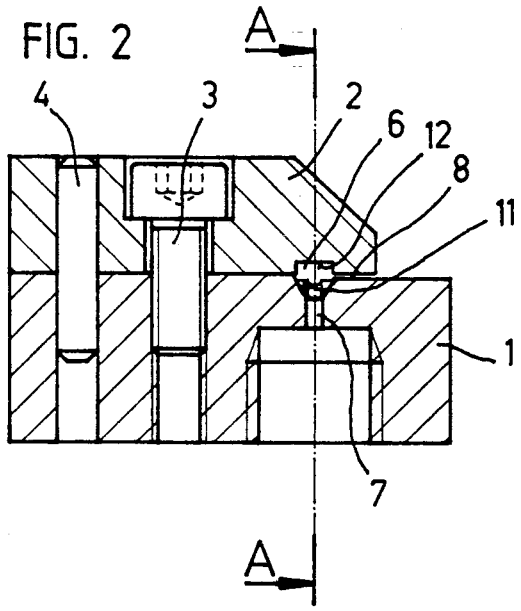
FIG. 2 is a vertical section through the body along line B—B in FIG. 1.
Figure 3:
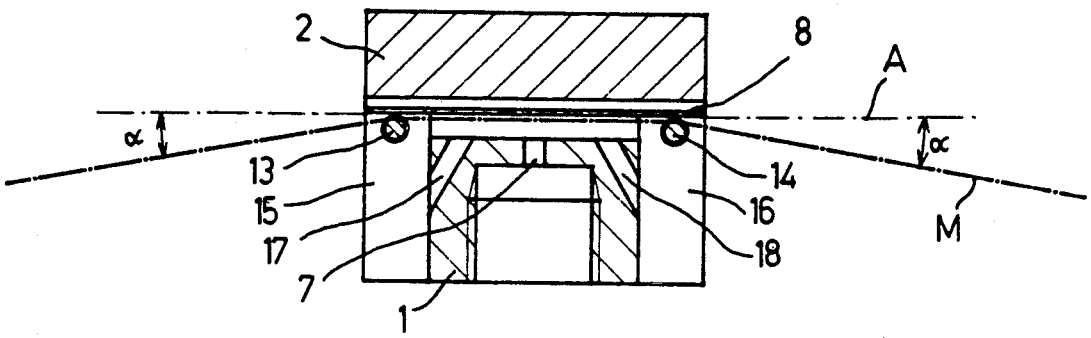
FIG. 3 shows a vertical section perpendicular to FIG. 2 along line A—A in FIG. 2.

According to FIGS. 1-3 device for the air-bulking of multifilament yarns comprises a bipartite body with a nozzle unit section 1 and a baffle unit section 2 which latter is exchangeably mounted to the nozzle unit section 1 by means of a screw 3 and two centering pins 4 and 5.

A yarn channel 6 extends linearly through the composite body 1, 2; at least one blast nozzle 7 contained in the nozzle unit section 1 as well as a threading slot 8 each terminates laterally into this yarn channel. The threading slot 8 is located, in the illustrated bipartite embodiment, between planar surfaces of the nozzle unit section 1 and of the baffle unit section 2.

The yarn channel 6 is formed by a groove with a first hollow wall surface 11 in the nozzle unit section 1 and by a groove with a second hollow wall surface 12 in the baffle unit section 2. It can be seen from FIG. 4 that the hollow wall surface in the baffle unit section 2 is symmetrical with respect to a plane of symmetry E containing the axis A of the yarn channel and is composed of three planar component surfaces 12.1, 12.2 and 12.3. (The axis A of the yarn channel can be defined as the [straight] line containing the centers of gravity of the surfaces of the yarn channel cross sections.) The component surfaces 12.1 and 12.2 extend approximately perpendicularly to the component surface 12.3; thus, the groove in the baffle unit section 2 is approximately rectangular in cross section. The first hollow wall surface in the nozzle unit section 1 is likewise symmetrical with respect to the plane of symmetry E; it is generally concave and composed of two planar component surfaces 11.1 and 11.2 inclined with respect to the plane of symmetry E and of a cylindrical component surface 11.3 connecting the component surfaces 11.1 and 11.2 with each other.

The blast nozzle 7 is likewise symmetrical to the plane of symmetry E. The nozzle can extend perpendicularly to the yarn channel axis A, as illustrated, or it could form an angle of between about 70° and 90° with this axis. The nozzle unit section 1 could also contain more than one blast nozzle; in such a case, each blast nozzle could be symmetrical with respect to the plane of symmetry E or two blast nozzles could also, for example, be arranged in mutual opposition symmetrically with respect to the plane of symmetry E.

The component surface 11.2 of the first hollow wall area emanates from a first (lower) rim of the orifice of the threading slot 8, and the component surface 12.2 of the second hollow wall area emanates from the second (upper) rim of the orifice of the threading slot 8. The first rim of the orifice of the threading slot has a larger distance from the plane of symmetry E than the second rim of this orifice.

The partial surface 11.1 symmetrical to the partial surface 11.2 extends up to a line lying symmetrically in opposition to the first rim of the orifice of the threading slot 8. Transitional wall surfaces are provided at the nozzle unit section 1 and/or at the baffle unit section 2 between this line and the rim of the component surface 12.1 lying symmetrically in opposition to the second rim of the orifice of the threading slot 8. However, instead, it would also be possible to arrange a second slot, the orifice of which would lie symmetrically in opposition to the orifice of the threading slot 8.

During operation, at least one multifilament yarn M (FIG. 3) moved in the longitudinal direction through the yarn channel 6, is air-bulked by means of a jet of blowing medium, e.g. compressed air and/or steam, entering the yarn channel 6 from the blast nozzle 7. In order to obtain a high intermingling density during this process, the yarn should contact substantially only the second hollow wall surface 12 in the baffle unit section 2, but only hardly the first hollow wall surface 11 containing the orifice of the blast nozzle 7. This is promoted, on the one hand, by the feature that the first (lower) rim of the threading slot 8 from which the first hollow wall surface 11 emanates has, as described above, a larger distance from the plane of symmetry E than the second (upper) rim of the threading slot from which the second hollow wall surface 12 starts. On the other hand, the yarn must be guided very accurately within the yarn channel 6. For this purpose, thread guides 13 and 14, for example in the form of glued-in sapphire pins, are inserted in the nozzle unit section 1 at both ends of the yarn channel 6. The thread guides 13 and 14 extend transversely through the yarn channel 6 in such a way that a thread laid over these thread guides 13 and 14 has, in the tensioned condition, no contact with the first hollow wall surface 11 but rather has a spacing h from this first hollow wall surface 11 as measured in the plane of symmetry E which preferably amounts to 5–50% of the distance H, measured in the plane of symmetry E, from the first hollow wall surface 11 to the second hollow wall surface 12. In this connection, it is advantageous to guide the multifilament yarn M (or several multifilament yarns) toward one of the thread guides 13 or 14 and to take the yarn off from the other thread guide in directions which lie approximately in the plane of symmetry E and form angles $\alpha$ of 2°–20° with the axis A of the yarn channel.

In order to prevent interference with the efflux of the blowing medium from the two ends of the yarn channel 6 by the thread guides 13 and 14, lateral outlet openings for the blowing medium extend from the yarn channel 6 in front of the thread guides (as seen from the orifice of the blast nozzle 7). In accordance with FIGS. 1 and 3, these outlet openings are, for example, grooves 15 and 16 and/or bores 17 and 18 in the nozzle unit section 1, emanating from the groove of the nozzle unit section 1 exhibiting the first hollow wall surface 11. The cross section of the outlet openings is larger than the portion of the cross section of the yarn channel 6 blocked by the respective thread guide 13 or 14 and, respectively, larger than the projection area in the direction of the yarn channel axis A of the portion of the respective thread guide 13 or 14 projecting into the profile of the yarn channel 6.

Thanks to the aforedescribed features, particularly also thanks to the planar configuration of the three component surfaces 12.1, 12.2 and 12.3 of which the hollow wall surface 12 in the baffle unit section 2 is composed, it has been possible to achieve by means of the device according to FIGS. 1 through 4 in a POY spinning machine very high air-bulking densities of, on the average, above 45 FP/m under production conditions and, on the average, above 50 FP/m under laboratory conditions; the polyester yarn employed had a POY titer of about 75–85 dtex with about 36–45 filaments and traveled through the yarn channel at 3,000 m/min. This means that, per second, 2,500 fixed points were formed in the yarn. At the same time, the energy consumption per fixed point could be lowered to below half of the values customary heretofore. Thus, the energy utilized in the above example amounted to 0.44 $m^3$ of compressed air (in the normal condition) per 1 million of fixed points formed, at a manometric aid pressure of 6 bar.

Figure 4:
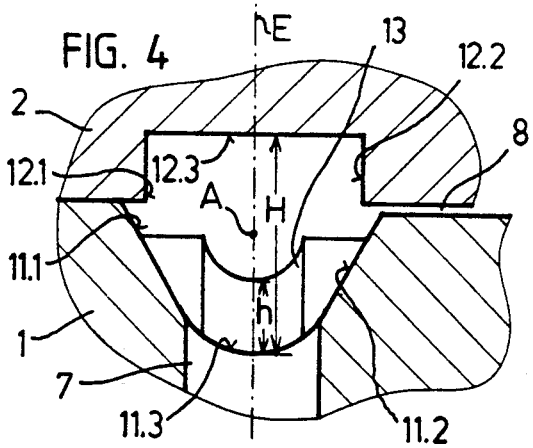
FIG. 4 shows, on an enlarged scale, a detail of FIG. 2, illustrating the cross section of the yarn channel.

FIGS. 5 through 11 show views similar to the view of FIG. 4 for modified embodiments of the bipartite body of the air-bulking device. In these modified embodiments, the groove in the nozzle unit section forming a portion of the yarn channel and/or the groove in the baffle unit section exhibit varying cross-sectional shapes which, however, are in all cases symmetrical with respect to the plane of symmetry E.

Figure 5:
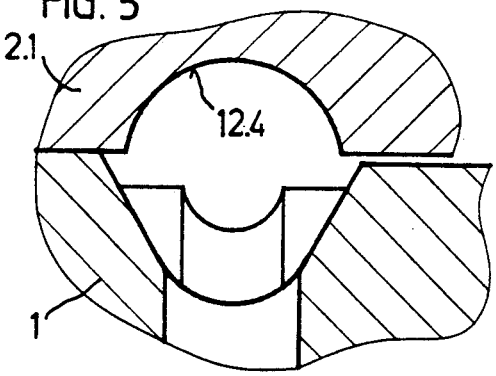
FIG. 5 through FIG. 11 show, in identical views to the view of FIG. 4, various other possible configurations of the yarn channel cross section.

According to FIG. 5, the groove in the nozzle unit section 1 and, respectively, the first hollow wall surface have the same shape as described connection with FIG. 4. The second hollow wall surface in the baffle unit section 2.1 consists of a concave cylindrical surface 12.4. Exchanging the baffle unit section 2 of FIG. 4 against the baffle unit section 2.1 according to FIG. 5 yields a device, with an identical nozzle unit section 1, which produces in a multifilament yarn a lower air-bulking density under the same operating conditions.

Figure 6:
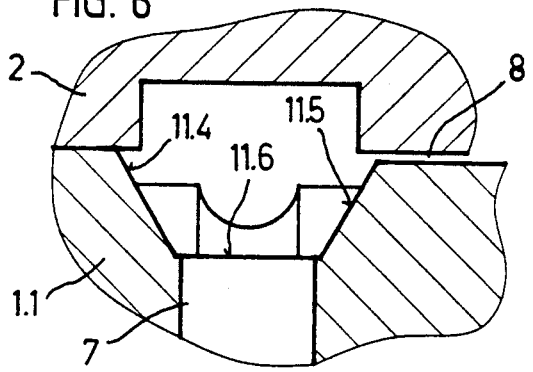
Figure 7:
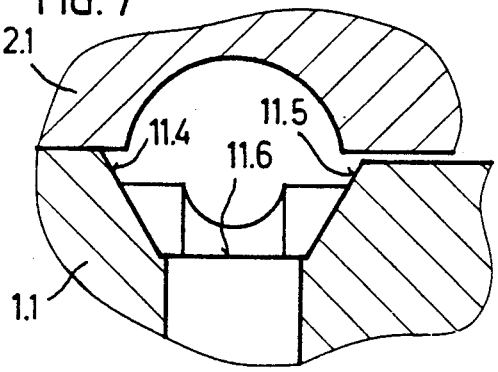

FIGS. 6 and 7 show embodiments wherein the groove in the nozzle unit section 1.1 has a modified shape. The first hollow wall surface is composed of three planar component surfaces 11.4, 11.5 and 11.6. The nozzle unit section 1.1 can be utilized, according to FIG. 6, with the baffle unit section 2 described with reference to FIG. 4, or, according to FIG. 7, with the baffle unit section 2.1 described in connection with FIG. 5.

Figure 8:
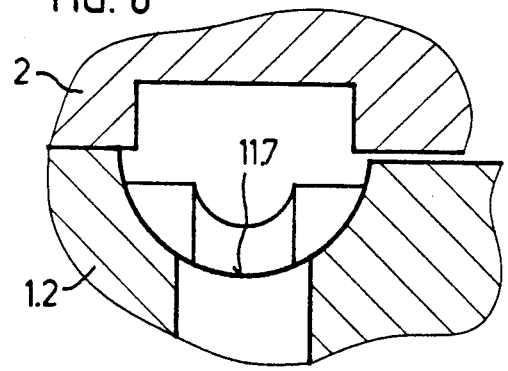
Figure 9:
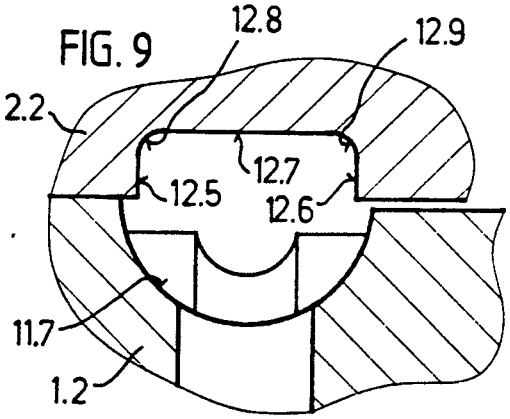

In FIGS. 8 and 9, the groove in the nozzle unit section 1.2 has still another cross-sectional shape. The first hollow wall surface in the nozzle unit section 1.2 consists of a concave cylindrical surface 11.7. The nozzle unit section 1.2 is utilized, according to FIG. 8, with the baffle unit section 2 described with reference to FIG. 4, whereas it is used according to FIG. 9 with a baffle unit section 2.2 wherein the second hollow wall surface is composed of three planar component surfaces 12.5, 12.6 and 12.7 and of two cylindrical component surfaces 12.8 and 12.9 which connect these planar component surfaces with each other in pairs.

Figure 10:
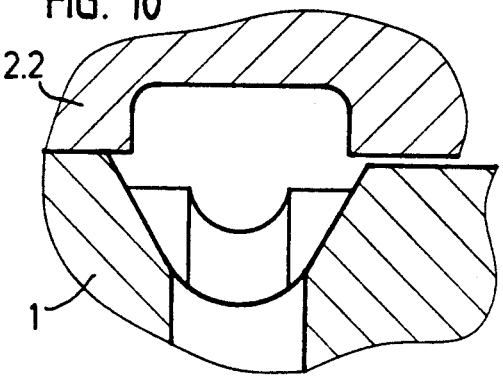
Figure 11:
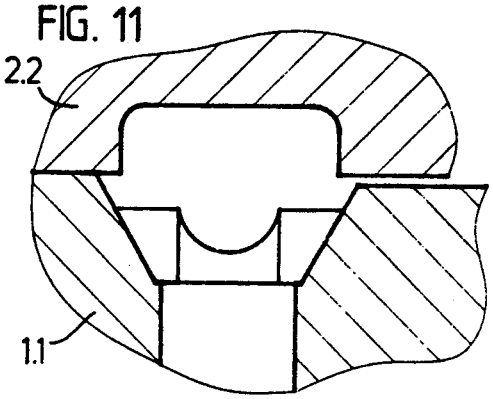

FIGS. 10 and 11 show that the baffle unit section 2.2 described with reference to FIG. 9 can also be used together with the nozzle unit section 1 according to FIG. 4 and/or with the nozzle unit section 1.1 according to FIG. 6.

In the above-described embodiments, the baffle unit section is in all cases attached to the nozzle unit section in an exchangeable fashion; however, it is clearly apparent that the baffle unit section could also be permanently joined to the nozzle unit section or fashioned integrally with the latter.

In all embodiments, the profile of the yarn channel is defined by two hollow wall surfaces, each of which is symmetrical with respect to the plane of symmetry E, these wall surfaces jointly containing at least four component surfaces of which at least two are planar. These component surfaces are, in FIG. 4, the planar component surfaces 11.1, 11.2, 12.1, 12.2 and 12.3 and the cylindrical component surface 11.3. In the embodiment according to FIG. 5, these are the planar component surfaces 11.1 and 11.2 and the cylindrical component surfaces 11.3 and 12.4; according to FIG. 6, the planar component surfaces 11.4, 11.5, 11.6, 12.1, 12.2 and 12.3; according to FIG. 7, the planar component surfaces 11.4, 11.5, 11.6 and the cylindrical component surface 12.4; according to FIG. 8, the planar component surfaces 12.1, 12.2, 12.3 and the cylindrical component surface 11.7; according to FIG. 9, the planar component surfaces 12.5, 12.6, 12.7 and the cylindrical component surfaces 11.7, 12.8 and 12.9; according to FIG. 10, the planar component surfaces 11.1, 11.2, 12.5, 12.6, 12.7 and the cylindrical component surfaces 11.3, 12.8 and 12.9; according to FIG. 11, the planar component surfaces 11.4, 11.5, 11.6, 12.5, 12.6, 12.7 and the cylindrical component surfaces 12.8 and 12.9.

I claim:

1. A device for intermingling multifilament yarns, comprising: a body (1, 2) composed of two sections secured to one another, namely a nozzle unit section (1) and an impingement unit section (2), said nozzle unit section (1) being formed with a first continuous linear groove defined by a first hollow wall surface (11), and with at least one blast nozzle (7) having an orifice in said first hollow wall surface (11), said impingement unit section (2) being formed with a second continuous linear groove defined by a second hollow wall surface (12) which lies in opposition to said orifice, said first and second hollow wall surfaces (11, 12) together defining a continuous yarn channel (6) having a longitudinal axis (A), and said hollow wall surfaces (11, 12) each being symmetrical with respect to a plane of symmetry (E) containing said longitudinal axis (A), a continuous threading slot (9) communicating with said yarn channel provided between said nozzle unit section (1) and said impingement unit section (2) and extending to a rim of said first hollow wall surface (11) and to a rim of said second hollow wall surface (12), said rim of said first hollow wall surface (11) having a greater spacing from said plane of symmetry (E) than said rim of said second hollow wall surface (12), said first and second hollow wall surfaces (11, 12) defining said yarn channel (6) together being composed of at least four component surfaces of which at least two are planar, and thread guide members (13, 14) fixed directly in said nozzle unit section (1) at both ends of said yarn channel (6) for keeping any multifilament yarn, which is tensioned over said thread guide members (13, 14), at a distance h from said first hollow wall surface (11).

2. Device according to claim 1, wherein said at least one blast nozzle (7) is symmetrical with respect to the plane of symmetry (E).

3. Device according to claim 1, wherein the first and second hollow wall surfaces (11, 12) have a spacing H between them as measured in the plane of symmetry (E), and wherein the thread guide members (13, 14) are positioned so that said distance h of a multifilament yarn from the first hollow wall surface (11), as measured in the plane of symmetry (E), amounts to 5–50% of the spacing H.

4. Device according to claim 1, wherein lateral openings (15, 16; 17, 18) emanate from the yarn channel (6) in front of the thread guide members (13, 14) as seen from the orifice of the blast nozzle (7).

5. Device according to claim 4, wherein the cross section of the outlet openings (15, 16; 17, 18) is larger than the portion of the cross section of the yarn channel (6) blocked by the thread guide members (13, 14).

6. Device according to claim 1, further including means for guiding at least one multifilament yarn (M) toward one of the thread guide members (13, 14) and means for taking off the yarn from the other thread guide member in direction which lie approximately in the plane of symmetry (E) and form an angle ($\alpha$) of 2°–20° with the longitudinal axis (A) of the yarn channel (6).

* * * * *